United States Patent [19]

O'Loughlin

[11] Patent Number: 4,963,799

[45] Date of Patent: Oct. 16, 1990

[54] ACOUSTIC ENHANCEMENT OF MULTICHANNEL SPARK GAP

[75] Inventor: James P. O'Loughlin, Albuquerque, N. Mex.

[73] Assignee: The United States of America as represented by the Secretary of the Air Force, Washington, D.C.

[21] Appl. No.: 311,688

[22] Filed: Feb. 16, 1989

[51] Int. Cl.[5] ..... H01J 17/30

[52] U.S. Cl. ..... 315/345; 315/150; 315/342

[58] Field of Search ..... 315/149, 150, 326, 341, 315/342, 344, 345; 313/567

[56] References Cited

U.S. PATENT DOCUMENTS

| | | | |
|---|---|---|---|
| 3,798,484 | 3/1974 | Rich | 313/198 |
| 4,191,908 | 3/1980 | Cunningham | 313/325 |
| 4,194,138 | 3/1980 | Johansson et al. | 313/3 |
| 4,267,484 | 5/1981 | O'Loughlin | 313/325 |
| 4,431,946 | 2/1984 | O'Loughlin | 315/150 |
| 4,484,106 | 11/1984 | Taylor et al. | 315/150 |
| 4,672,259 | 6/1987 | Riggins et al. | 313/231.11 |

*Primary Examiner*—David Mis

*Attorney, Agent, or Firm*—William G. Auton; Donald J. Singer

[57] ABSTRACT

A spark gap system is disclosed that includes an enclosure which contains a gas medium; two rail electrodes which extend into the enclosure and which are separated from each other by the gas medium, a trigger blade which ionizes the gas medium to cause it to be a conductor between the two electrodes through a series of electrical arc channels in the gas medium, and an acoustic driver which generates a standing acoustic wave in the gas medium. The standing acoustic wave generates a pressure density profile that distributes the electrical arc channels along the wave nodes of the standing acoustic wave. This has the result of evenly distributing the electrical arc channels along the first and second rail electrodes when the gas medium is ionized, and improving the spark gap system performance.

6 Claims, 4 Drawing Sheets

ACOUSTIC ENHANCEMENT OF MULTICHANNEL SPARK GAP

STATEMENT OF GOVERNMENT INTEREST

The invention described herein may be manufactured and used by or for the Government for governmental purpose without the payment of any royalty thereon.

BACKGROUND OF THE INVENTION

This invention relates generally to a multichannel spark gap system, and more specifically to a system which enhances multichannel spark gaps in which an acoustic standing wave is set up along the electrode which induces a modulation of the gas molecular number density.

Spark gap switches are commonly used in pulse generators to switch the energy in the pulse forming energy store into the load or transmission circuit. In low impedance circuits the switch inductance becomes an important factor in determining the rise time of the pulse. The inductance is determined in the limit by the spacing between the gap electrodes which depends upon the gas density and the operating voltage. Typical values are about 60 nanohenrys per megavolt at 10 amagat of air. This value is for a single spark discharge channel. If the system rise time requirements demand it, one must use multiple switches or spark discharge channels in parallel to lower the inductance. This is commonly done using a rail gap switch, wherein the electrodes are linear rails and the object is to initiate several parallel discharge channels along the length of the rails. This is a statistical process. When the gap is triggered emission sites are initiated on the cathode depending upon the random condition of the fine structure of the cathode surface and the local electric field strength. These sites do not initiate at the same time for these very reasons. When the first site develops into a spark channel and completes the circuit the anode to cathode voltage falls and no further sites can be initiated. Therefore in order to initiate many sites, the rise time of the trigger must be fast in relation to the closure time of the first site. Still the whole process is of a statistical nature and the number and location of the channels established by the trigger pulse is not dependable on a shot to shot basis. Thus, the inductance and rise time will fluctuate accordingly.

Exemplary in the art of spark gap switch technology are the following U.S. Patents, the disclosure of which are incorporated herein by reference:

- U.S. Pat. No. 4,267,484 issued to James P. O'Loughlin;
- U.S. Pat. No. 4,431,946 issued to James P. O'Loughlin;
- U.S. Pat. No. 4,672,259 issued to Riggins et al;
- U.S. Pat. No. 4,191,908 issued to Cunningham
- U.S. Pat. No. 4,194,138 issued to Johansson et al;
- U.S. Pat. No. 3,798,484 issued to Rich; and
- U.S. Pat. No. 4,084,208 issued to Bazarian et al.

All of the above-cited references describe developments in spark gap technology. Of particular note are the two James P. O'Loughlin references, which each disclose multi-channel spark gap systems. In all spark gap systems, it is noted that the electrical breakdown criterion of a gas is determined by the ratio of the electric field (E) to the molecular number density (N) to E/N. In conventional gaps the sites where the emission initiates on the cathode, breakdowns are established by the fact that the cathode surface has small irregularities which cause the local field E to be enhanced and thus establishes regions where a higher E/N exists. The gas pressure is static and thus N is the same everywhere. These local E/N enhancements induce the initiations at these sites. Since the discharge erodes the cathode surface, the number and location of these enhanced site areas are random.

In view of the foregoing discussion, it is apparent that there currently exists the need for a system will control the location of the arc channels and thereby distribute the errosion over the entire electrode length. The present invention does this as it introduces a standing wave density distribution within the gas medium of spark gap switches. This results in a controlled distribution of the location of the arc channels, and distributes the erosion over the entire length of the electrodes as discussed below.

SUMMARY OF THE INVENTION

The present invention is a system which provides an enhancement of multi-channel spark gaps in which an acoustic standing wave is set up along the electrode which induces a modulation of the gas molecular number density. The breakdown of the gas depends upon the ratio of the electric field, E, and the local molecular number density, N; i.e. E/N. Without acoustic enhancement the arc channel sites are established randomly depending upon local surface defects, on the electrode which locally enhance the E/N. The acoustic enhancement the modulation of E/N overrides the enhancement due to surface defects and causes the establishment of arc channels at the standing wave nodes where the molecular number density is minimum. By controlling the location of the standing wave nodes, one can control the location of the arc channels.

One embodiment of the invention includes a gas-filled enclosure, two rail electrodes, a trigger blade, an acoustic driver and a reflecting wall. The two rail electrodes intrude into said gas-filled enclosure so that they are physically separated from each other by the gas medium. The trigger blade ionizes the gas medium so that it becomes a conductor and allows electricity to pass between the two electrodes. The acoustic driver is fixed to one end of the enclosure, and transmits an acoustic standing wave which has a frequency which produces an integral number of half wavelengths over the length of the enclosure. The reflecting wall is fixed to the far end of the enclosure opposite the acoustic driver and reflects the acoustic standing wave back into the enclosure to enhance the effectiveness of the acoustic driver. As described above, the system provides acoustic enhancement of the performance of the spark gap switch by a modulation of the gas medium which establishes arc channels at the locations of standing wave nodes where the molecular number density is minimum. This has the effect of evenly distributing the arc channels along the lengths of the rail electrodes for improved spark gap performance. This can also distribute the erosion over the entire length of the electrodes. It is an object of the present invention to enhance the electrical performance of multi-channel spark gap switch systems by uniformly distributing the arc channels along the length of the rail electrodes.

It is another object of the present invention to modulate the gas medium of the spark gap with an acoustic standing wave so that the arc channels are distributed at the standing wave nodes where the molecular number density is a minimum.

These objects together with other objects, features and advantages of the invention will become more readily apparent from the following detailed description when taken in conjunction with the accompanying drawings wherein like elements are given like reference numerals throughout.

DETAILED DESCRIPTION OF THE PREFERRED EMBODIMENT

The present invention is a system which provides an enhancement of multichannel spark gaps in which an acoustic standing wave is set up along the electrode which induces a modulation of the gas molecular number density. This modulation of the gas medium establishes the location of the electrical arc channel sites at the location of the accoustic standing wave nodes, where the molecular number density of the gas is minimum. By modulating the phase of the acoustic standing wave, these nodes and the arc channel sites are distributed over the entire length of the electrodes.

Figure 1:
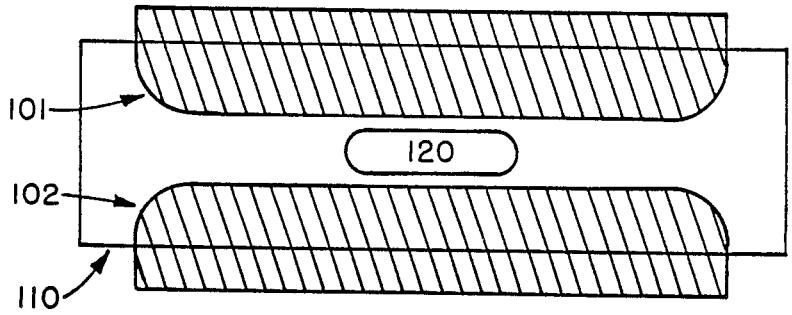
FIG. 1 PRIOR ART
FIGS. 1 and 2 are illustrations that respectively depict a side view and an end view of a prior art spark gap system.
Figure 2:
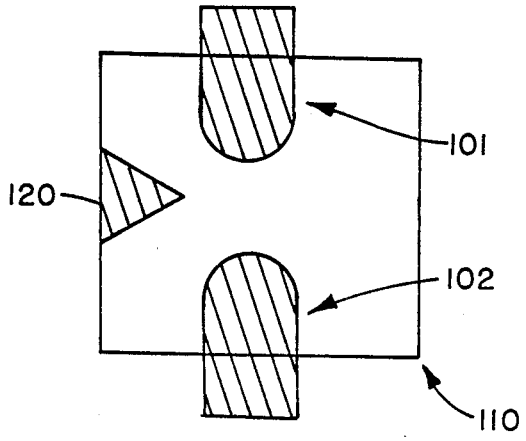
FIG. 2 PRIOR ART

The reader's attention is now directed towards FIGS. 1 and 2 which are illustrations that respectively depict a side view and an end view of a conventional prior art rail gap switch. This system includes two linear rail electrodes 101 and 102, one enclosure 110 which contains a gas medium, and a trigger blade 120. In operation, such systems work as described below.

The basic spark gap usually consists of two current-carrying electrodes separated by a dielectric (vacuum, gas, liquid, or solid). The electrodes are usually part of a coaxial or stripline system. The dielectric separating the electrodes is made to break down by overvolting the gap or by applying a trigger signal to a third (trigger) electrode. The most common basic trigger arrangement is shown in FIG. 1.

The theory behind the operation of such switches is as follows. The chamber 110 is filled with a gas, at high pressures. As described so far, the anode electrode 101 is effectively isolated from the cathode electrode 102 and the switch provides an open circuit between them. To close the circuit, an electrical pulse is sent down the centrally located trigger blade 120 to ionize the gas in the chamber 110. When ionized, the gas provides a medium for electrical contact between the anode 101 and the cathode 102.

In the system of FIG. 1, the rail electrodes extend virtually the entire length of the chamber 110, and this is a common practice which distributes an electrical charge over the length of the rail gap. There exists variations in the configurations because of the widely different applications in the art for which spark gap switches are used. As mentioned above, spark gap switches are commonly used in pulse generators to switch the energy in the pulse forming energy store into the load or transmission circuit. In low impedance circuits the switch inductance becomes an important factor in determining the rise time of the pulse. The inductance is determined in the limit by the spacing between the gap electrodes which depends upon the gas density and the operating voltage. Typical values are about 60 nanohenrys per megavolt at 10 amagat of air. This value is for a single spark discharge channel. If the system rise time requirements demand then one must use multiple switches or spark discharge channels in parallel to lower the inductance. This is commonly done using a rail gap switch, FIG. 1, wherein the electrodes are linear rails and the object is to initiate several parallel discharge channels along the length of the rails. This is a statistical process. When the gap is triggered, emission sites are initiated on the cathode depending upon the random condition of the fine structure of the cathode surface and the local electric field strength. These sites do not initiate at the same time for these very reasons. When the first site develops into a spark channel and completes the circuit the anode to cathode voltage falls and no further sites can be initiated. Therefore in order to initiate many sites, the rise time of the trigger must be fast in relation to the closure time of the first site. Still the whole process is of a statistical nature and the number and location of the channels established by the trigger pulse is not dependable on a shot to shot basis. Thus the inductance and rise time will fluctuate accordingly.

It has been noted that the electrical breakdown criterion of a gas is determined by the ratio of the electric field (E) o the molecular number density (N) to E/N. In conventional gaps the sites where the emission initiates on the cathode are established by the fact that the cathode surface has small irregularities which cause the local field E to be enhanced and thus establishes regions where a higher E/N exists. The gas pressure is static and thus N is the same everywhere. These local E/N enhancements induce the initiations at these sites. Since the discharge erodes the cathode surface the number and location of these enhanced site areas are random.

Figure 3:
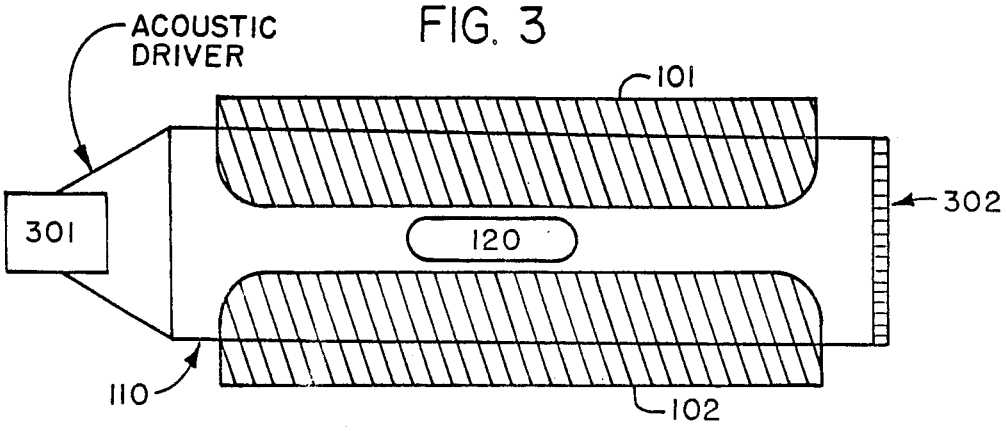
FIG. 3 is an illustration of the preferred embodiment of the present invention.

The reader's attention is now directed towards FIG. 3, which is an illustration of an embodiment of the present invention. The system of FIG. 3 includes a number of elements in common with the prior art system of FIG. 1. These common elements are known in the art and need not be elaborated upon. The referenced patents cited above provide examples of state-of-the-art multi-channel spark gap configurations and elaborate on the elements of FIGS. 1 and 2.

Figure 5:
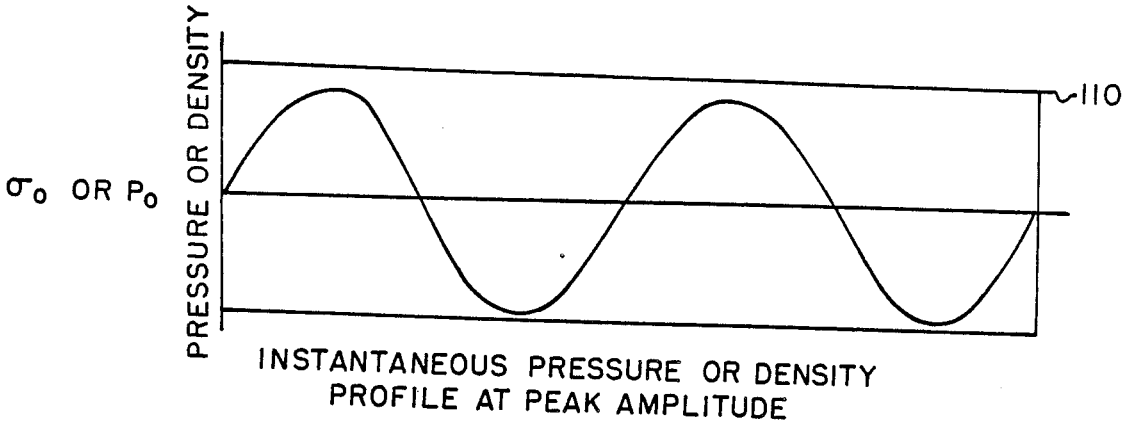
FIG. 5 is a chart of the density profile induced in the gas medium of the chamber by the acoustic wave of FIG. 4.

The system of FIG. 3 adds an acoustic driver 301 and a reflecting surface 302 to the chamber 110. This acoustic driver 301 introduces a standing acoustic wave along the rail gap which establishes a standing wave density distribution. That is the number density N will be modulated at the acoustic frequency and will be 180 degrees out of phase with adjacent half wave length points. Nodes will exist at a particular set of these points where the modulation of N will be maximum. At the correct time in each acoustic cycle the density will have a distribution as shown in FIG. 5 and will have the maximum peak to peak variation.

Figure 4:
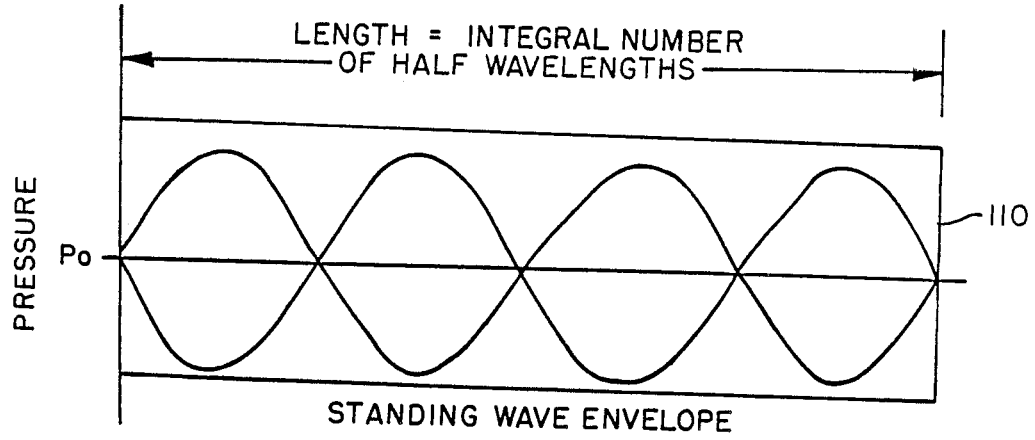
FIG. 4 is a, chart of the standing wave envelope produced by the acoustic driver of FIG. 3 in the chamber of the spark gap system.

The acoustic driver 301 is a commercially available transducer (such as a speaker) which converts an electrical signal into an acoustical tone. The frequency and wavelength produced by the acoustic driver are mathematically determined by the dimensions of the chamber 110. As illustrated in FIG. 4, the standing wave envelope of the acoustic wave has a wavelength which is selected so that an integral number of half wavelengths fits within the length of the chamber. On FIG. 4, a total of four half wavelengths fits within the length of the chamber 110. Therefore, the system of FIGS. 3–5 has an acoustic driver 301 that produces an acoustic wave with a wavelength which equals one-half of the length of the chamber 110.

In applying the present invention to any spark gap system, the user should first determine the length of the chamber of the spark gap. Next, the user should select an integral number of half waves that will open the length of the chamber and apply an acoustic driver 301 to one end of the chamber and a reflecting surface 302 to the other end.

We might ask "what frequency of acoustic signal is appropriate?" The answer can be derived in part from the physical nature of matter. The relationship of sound velocity, frequency, and wavelength ( $C=f\cdot\lambda$) is of particular importance , and is illustrated in a general way in FIG. 6.

Figure 6:
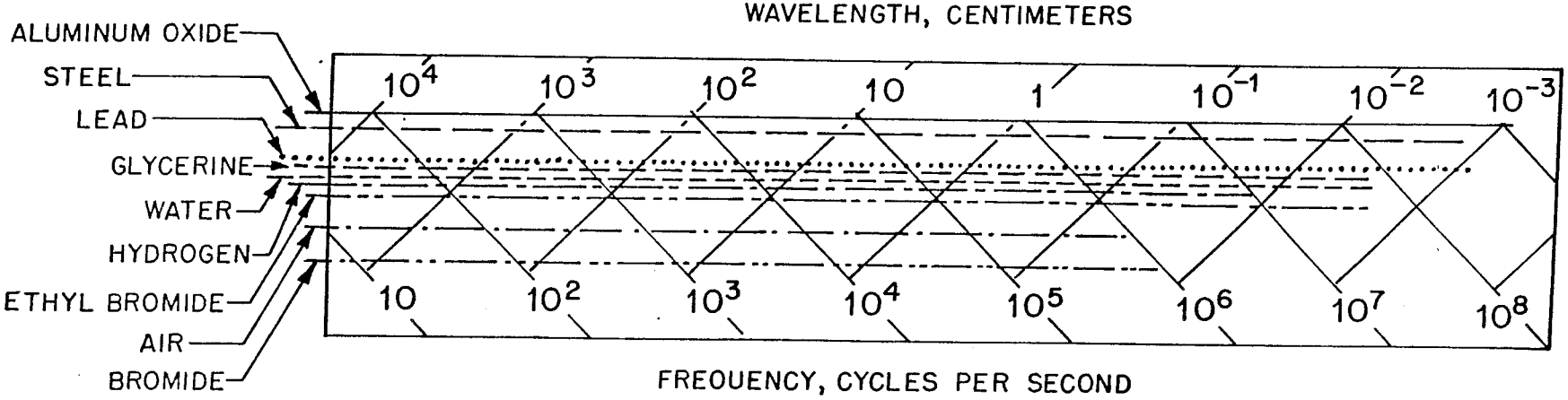
FIG. 6 is a chart which correlates the wavelength of acoustic waves with frequency as the waves propagate through different media.

The relationship of sound velocity, frequency, and wavelength is velocity equals the product of the wavelength multiplied by frequency. FIG. 6 equates the frequency (in cycles per second) with its corresponding wavelength (in centimeters) for sound as it travels though various media, including hydrogen and air. As the frequency of sound increases, the wavelength correspondingly decreases, as shown in FIG. 6.

FIG. 6 provides a correlation of velocity, frequency and wavelength for a number of general substances. However, the gas medium selected for use in the spark gap will have an effect on the velocity of sound travelling therein. For this reason, Table 1 is presented below in order to provide the accepted value of the velocity of sound in air and 12 gases at 0 degrees Celsius. From Table 1, the user can determine the velocity that sound will travel in the enclosure 110 of FIG. 3 when it contains one of these gases. The user can then decide on the wavelength and frequency selection appropriate for his spark gap device as follows. The user should select an acoustic generator which produces an acoustic wave such that an integral number of half wavelengths fits exactly within the length of the chamber of the spark gap.

TABLE 1

VELOCITY OF SOUND IN GASES AT 0° C.

| GAS | Velocity, m/sec | Velocity, ft/sec |
|---|---|---|
| Air | 331.45 | 1087.42 |
| Argon, Ar | 319 | 1046 |
| Carbon monoxide, CO | 337.1 | 1106 |
| Chlorine, $Cl_2$ | 205.3 | 674 |
| Ethylene, $C_2H_4$ | 314 | 1030 |
| Helium, He | 970 | 3182 |
| Hydrogen, $H_2$ | 1269.5 | 4165 |
| Neon, Ne | 435 | 1427 |
| Nitric Oxide, $N_2O$ | 325 | 1066 |
| Nitrogen, $N_2$ | 337 | 1096 |
| Nitrous oxide $N_2O$ | 261.8 | 859 |
| Oxygen, $O_2$ | 317.2 | 1041 |

TABLE 1-continued

VELOCITY OF SOUND IN GASES AT 0° C.

| GAS | Velocity, m/sec | Velocity, ft/sec |
|---|---|---|
| Sulphur Hexaflouride, $SF_6$ | 490.4 | 1609 |

The discussion so far is believed to fully enable one to practice the invention depicted in FIG. 3. This discussion has detailed how to practice the invention. What follows is a discussion of why the invention works.

The invention provides a means of obtaining consistent, reliable and dependable operation in the multichannel mode. To accomplish multichannel operation an acoustic standing wave is set up along the electrode which includes a modulation of the gas molecular number density. The breakdown of the gas depends upon the ratio of the electric field, E, and the local molecular number density, N; i.e. mE/N. Without acoustic enhancement the arc channel sites are established depending upon local surface defect on the electrode which locally enhance the E/N. With acoustic enhancement the modulation of E/N overrides the enhancement due to surface defects and causes the establishment of arc channels at the standing wave nodes where the molecular number density is minimum.

Thus the regions of low N will have the maximum E/N and will be more enhanced with respect to initiating a breakdown, depending upon the maximum variation in N. It will be shown later that it is possible to establish peak to peak variations in N of 20% to 40% with feasible acoustic apparatus and gap designs. The amount of the resulting electrical breakdown enhancement is sufficient to completely mask random enhancements due to the small surface irregularities. The effect being that the number and position of the ionization channels will be fixed by the standing wave density minima when the gap is triggered and synchronized with the extreme of the minima. The extreme of the minima must be fixed by design to be above the self-break density of the switch. A switch incorporating these features of the invention will have a fixed number of discharge channels at fixed locations and will have a consistent and dependable shot to shot inductance. Also, with the enhanced conditions at the time of triggering the design of the trigger circuit can be relaxed to a lower performance and more economic type. Still another advantage is the fact that the position of the arc channels can be moved about a uniform erosion over the entire electrode surface which will result in an increase of electrode life as well as a more uniform surface being maintained during the life of the switch.

In a gas such as air, the pressure and volume changes due to an acoustic wave are adiabatic, that is:

$$p\cdot V^g=\text{constant} \quad [1]$$

where:

p=pressure in a volume increment

V =volume increment g =the ratio of specific heat at constant pressure to that at constant volume Since the number of molecules in the volume V is constant then the molecular density is inversely proportional to V thus:

$$RHO=\text{constant } [P]^{1/g} \quad [2]$$

where: RHO=the density g=1.4 for air
P=pressure

A density change of about plus or minus 20% corresponds to a pressure change of about plus or minus 28.5%. There is a small non-linearity at this level which is less than 0.5% and is negligible for the purpose at hand. In fact, for level of this order a linear approximately is sufficient:

$$RHO/RHO_o = P/[g \cdot P_o] \quad [2a]$$

A plane acoustic wave propagating in the x [+/−] direction has a pressure:

$$p[x,t] = Re\,[p+\exp[jk[ct-x]] + p-\ \exp[jk[ct+x]]] \quad [3]$$

where:
p+=peak pressure of the positive x wave
p−=peak pressure of the negative x wave
k=velocity
t=time
Re=real part operator In FIG. 2 a rail gap is shown enclosed in a long tube with an acoustic driver at one end and a reflecting wall at the other end. The entire structure is made of highly acoustic reflecting material such that a strong standing wave is established with a minimum of acoustic power input required from the driver. Typically, metals, glass, plastics and such materials have acoustic absorption coefficients (energy) of about 0.02 in the audio spectrum. This corresponds to a pressure reflection coefficient, R, of about 0.99. If the initial pressure from the driver is p+ then the amplitude of the first reflection will be R p+, with no phase reversal. If the length of the structure between the driver and the end wall is an integral number of wavelengths, then the reflection of the reflected wave from the driver will be in phase with the driver and it will have an amplitude of $R_2$ p+. In the limit for this case equation 3 becomes:

$$p[x,t] = p+[\exp[jk[ct-x]] + R\exp[jk[ct+x]]]/[1-R^2] \quad [3a]$$

Thus the "Q" of the structure causes an increase in the pressure level due to the standing wave which is equal to $[1+R]/[1-R^2]$ or about a factor of 100. The actual acoustic power delivered by the driver is about 20 dB less than the power required to establish the same pressure level if the wave were a plane wave propagating in one direction. The intensity, or watts per square meter, Of a plane wave is given by:

$$I = [p+]^2/[2 \cdot RHO_o \cdot c] \quad [4]$$

where:
$RHO_o$=mean density of the gas
c=velocity of propagation
I=intensity in watts per square meter For a configuration such as in FIGS. 3–5, the intensity of the driver is given by:

$$I_d = A \cdot [P \cdot g]\,[1-R^2]\,SIG^2/[2[1+R]\,SQRT[RHO_o]] \quad [5]$$

where:
A=mean pressure in amagat (i.e., A times the density at STP)
$P_o$=STP pressure, 100,000 newtons/sq meter
g=1.4 for air
SIG=peak density modulation as a fraction of the mean density
$RHO_o$=STP density, 1.29 kg/cubic meter
R=pressure reflection coefficient, 0.99
$I_d$=intensity of the driver, watts / sq meter Thus for a device operating at 10 amagat [A=10], with air [g=1.4], and a 20% density modulation [SIG=0.2]; the driver intensity is 180,000 watts/sq m, or 18 watts/sq cm, which is a reasonable power level especially if it is only pulsed during the triggering interval.

Figure 7:
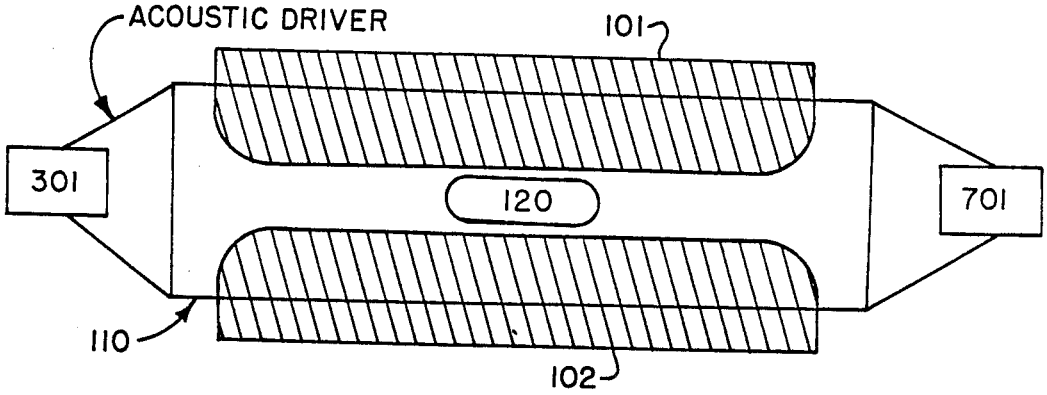
FIG. 7 is an illustration of another embodiment of the present invention.

The effect of the acoustic driver of FIGS. 3–5 is to generate the acoustic standing wave which modulates the gas medium in a manner which establishes arc channels along the rail electrodes at locations of the standing wave nodes in the chamber where the molecular number density of the gas medium is a minimum. This acoustic enhancement improves the performance of spark gap switch systems by evenly distributing the arc channels along the rail electrodes. As noted above, without such acoustic enhancement, arc channels are randomly established between the rail electrodes, and are a product of surface defect in the rail electrodes more than anything else. The reader's attention is now directed towards FIG. 7 which is an illustration of another embodiment of the present invention. The system of FIG. 7 is an acoustically enhanced spark gap system that uses two acoustic wave generators 301 and 701 to acoustically enhance the performance of a spark gap system. Each of the acoustic wave generators produce an acoustic wave such that an integral number of half wavelengths fit exactly in the enclosure 110. As discussed above, the effects of the acoustic wave include a modulation of the gas medium between the two rail electrodes 101 and 102 to evenly distribute the arc channels of the gas along the lengths of the rail electrodes for improved spark gap performance in the manner discussed below.

As mentioned earlier, the two electrodes 101 and 102 are separated from each in the chamber 110 by a gas medium $N_2$ or $SF_6$. When an electrical pulse from the trigger blade 120 ionizes the gas in the chamber 110, the gas becomes a conducting medium between the two electrodes as electrical arc channels are established. Normally, these arc channels have a somewhat random distribution along the lengths of the rail electrodes and seem to be located by surface defects in the electrodes more than anything else. However, when the two acoustic wave generators 301 and 701 have the same frequency and phase, and when they generate an acoustic wave signal such that an integral number of half waves exactly fit in the chamber 110 (as shown in FIG. 4) the acoustic wave modulates the gas medium. When the gas medium in the chamber 110 is modulated as shown in FIG. 4, the arc channel sites between the two rail electrodes 101 and 102 are located at the modes of the acoustic standing wave, where the molecular number density of the gas medium is at a minimum.

Figure 8:
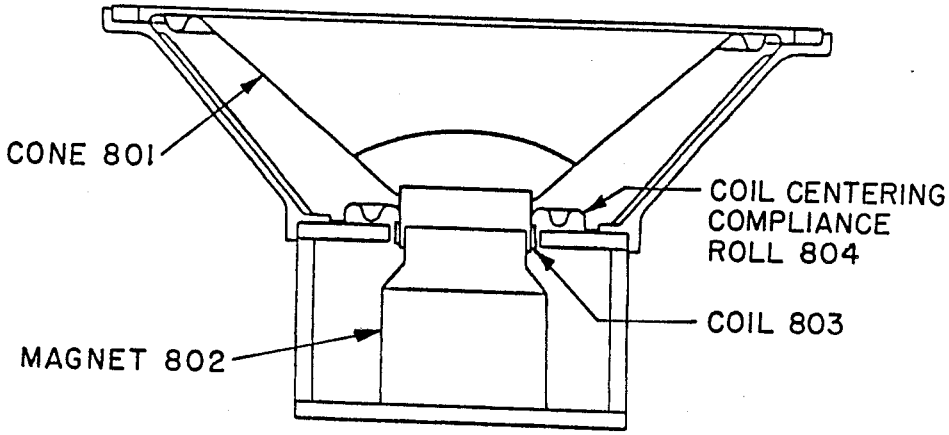
FIGS. 8 and 9 are illustrations of two types of acoustic drivers.
Figure 9:
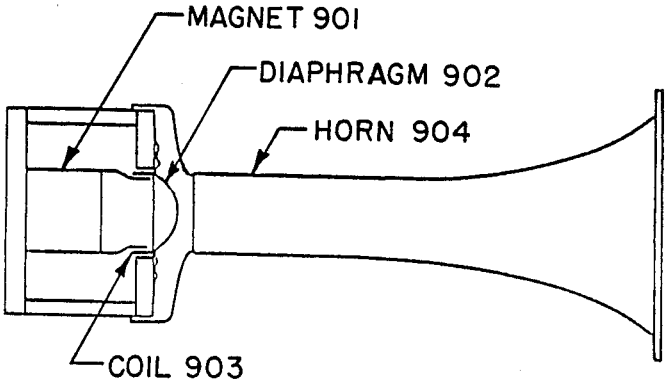

Acoustic enhancement, as described above has the effect of evenly distributing the electrical arc channels along the lengths of the rail electrodes. FIGS. 8 and 9 are illustrations of two types of acoustic wave generators and are discussed briefly below.

An acoustic wave generator is an electro-acoustic transducer that converts electric energy into sound energy.

The system of FIG. 8 is a dual radiating acoustic wave generator. The electromagnetic transducer generates an acoustic wave from an electrical signal using a cone 801, a magnetic 802, and a coil 803. The coil 803 is suspended in a magnetic field produced by the magnet 802 so that it produces a driving force in response to the electric signal. Displacement of the cone by this driving force results in the radiation of sound power. Frequency response, and efficiency are important measures of performance.

The system of FIG. 9 is a horn type acoustic generator. This system is electro-magnetic as in the direct radiating type, the magnet 901, steel structure, coil 903, and diaphragm 902 forms the basic generating unit. The diaphragm 902 is coupled acoustically to the throat of a horn 904.

Efficiency conversion, measured by the sound output level for a specified electrical power input, is an important measure of the performance of the acoustic generator. However, in the context of the present invention, the critical factor of the acoustic wave generators of both FIGS. 8 and 9 is to select a frequency which results in an integral number of half wavelengths being exactly modulated over the length of the spark gap chamber. As discussed above, this is the advantage of acoustic enhancement of spark gap systems.

As discussed in the above-cited patents by James P. O'Loughlin the electrodes of spark gap systems eventually experience erosion at points on their surface which continuously serve as the locations of the electrical arcs between the two electrodes. As described above, the present invention introduces an acoustic wave which distributes the electrical arc to controlled points: they are located at the nodes of the acoustic wave. In operation, the arc channel sites can be moved along the electrodes of the spark gap assembly to different sites by sequential adjustment in the modulation of the phase of the acoustic wave. This is accomplished in the manner described below.

Table 1 presents the velocity of sound in air and twelve gases. In all wave phenomena (including sound waves) the velocity of the wave equals the wavelength multiplied by the frequency. In the system of FIG. 3, since the user of the spark gap knows the velocity of sound, he selects an acoustic generator which produces an acoustic wave such that an integral number of half wavelengths fit exactly within the chamber of the spark gap. The acoustic standing wave in the spark gap assembly induces a modulation of the gas molecular density to distribute the arc channel sites along the nodes of the acoustic wave. When two acoustic drivers are used, as shown in the system of FIG. 7, both acoustic drivers do not have to use sound with an integral number of half wavelengths if the following principles are followed. First, both acoustic drivers 301 and 701 should operate at the same frequency. Second, by modulating the phase of the second driver 701, the second driver will adjust the nodes of sound as its acoustic wave interacts with that of the first acoustic driver. Finally with continuous modulation of the phase there can be a continuous repositioning of the electrical arc points along the electrodes. This has the effect of distributing the erosion over the entire electrode in a controlled manner.

The invention, as described above will increase the lifetime of electrodes in spark gap assemblies by controlling the location of electrical arc cites, and continuously redistributing them along the entire length of electrodes. Since the electrical arc cites are redistributed to different controlled locations, the erosion is redistributed along the entire length of the electrodes. This distribution of the erosion is much better than allowing the arc cites to continuously remain at one or more single locations.

While the invention has been described in its presently preferred embodiment, it is understood that the words which have been used are words of description rather than words of limitation and that changes within the purview of the appended claims may be made without departing from the scope and spirit of the invention in its broader aspects.

What is claimed is:

1. A spark gap assembly comprising:

an enclosure which contains a gas medium;

a first and a second rail electrode which extend into said enclosure and which are physically separated from each other by said gas medium;

a means for ionizing said gas medium, said ionizing means being mixed in said enclosure and ionizing said gas medium so that it conducts electricity between said first and second rail electrodes along a series of arc channels in said gas medium; and a means for generating a standing acoustic wave in said enclosure and said gas medium, said generating means being fixed within said enclosure and distributing said series of arc channels in said gas medium at location of standing wave nodes of said standing acoustic wave, said generating means thereby evenly distributing said arc channels along said first and second rail electrodes, since said arc channels will form at the location of the standing wave nodes where the gas medium's molecular number density is a minimum.

2. A spark gap assembly as defined in claim 1, wherein said generating means comprises:

an acoustic driver which is fixed at a first end of said enclosure and which generates said standing acoustic wave at a particular frequency such that an integral number of half wavelengths of said standing acoustic wave exactly fits within said enclosure; and a reflecting wall which is fixed at a second end of said enclosure so that it faces said acoustic driver and reflects said standing acoustic wave back into said enclosure to establish said standing wave and enhance its effect upon said gas medium.

3. A spark gap assembly comprising:

an enclosure which contains a gas medium;

a first and second rail electrode which extend into said enclosure and which are physically separated from each other by said gas medium;

a means for ionizing said gas medium, said ionizing means being fixed in said enclosure and ionizing said gas medium so that it conducts electricity between said first and second rail electrodes along a series of arc channels in said gas medium;

a first acoustic driver which is fixed at a first end of said enclosure and which generates a standing acoustic wave at a particular frequency such that an integral number of half wavelengths of said standing acoustic wave exactly fit within said enclosure; and a second acoustic driver which is fixed at a second end of said enclosure so that it faces said first acoustic driver said second acoustic driver which is in synchronization with the standing acoustic wave's frequency and phase.

4. A process of improving performance in a spark gap assembly which uses an enclosure which contains a gas medium, a first and second rail electrode which extends into said enclosure and which are physically separated from each other by said gas medium, and a means for ionizing said gas medium so that it conducts electricity between said first and second rail electrodes along a series of arc channels in said gas medium, said process comprising a step of generating a standing acoustic wave in said gas medium in said enclosure such that an integral number of half wavelengths of said standing acoustic wave exactly fits with the enclosure's length and a pressure density profile develops in said gas medium such that said arc channels are evenly distributed along locations of standing wave nodes for an even distribution of arc channels along said first and second rail electrodes.

5. A process, as defined in claim 4 wherein said generating step includes a continuous modulation of phase in said standing acoustic wave to continuously reposition said standing wave nodes over the first and second rail electrode's entire length, said generating step thereby repositioning said arc channels over the entire length of the first and second rail electrodes since said arc channels will form at locations of the standing wave nodes where the gas medium's molecular number density is a minimum, said generating step thereby distributing electrical erosion of the first and second rail electrodes over their entire length to prolong thereby the spark gap assembly's lifetime.

6. A spark gap assembly comprising:

an enclosure which contains a gas medium a first and a second rail electrode which extend into said enclosure and which are physically separated from each other by said gas medium;

a means for ionizing said gas medium, said ionizing means being fixed in said enclosure and ionizing said gas medium so that it conducts electricity between said first and second rail electrodes along a series of arc channels in said gas medium;

a first acoustic driver which is fixed at a first end of said enclosure and which generates standing acoustic wave at a particular frequency such that said arc channels are located at nodes in said standing acoustic wave where the gas medium's molecular number density is a minimum; and a second acoustic driver which is fixed at a second end of said enclosure so that it faces said first acoustic driver, said second acoustic driver being initially in synchronization with the standing acoustic wave's frequency and phase, said second acoustic driver sequentially modulating its phase to adjust the standing acoustic wave's nodes so that the arc channels are repositioned along the first and second said electrode's entire lengths.

* * * * *